United States Patent [19]

Walker

[11] 4,351,453

[45] Sep. 28, 1982

[54] OIL SPOUT WITH VALVE

[76] Inventor: Alan E. Walker, 1124 Parc Dr., Papillion, Nebr. 68046

[21] Appl. No.: 197,920

[22] Filed: Oct. 17, 1980

[51] Int. Cl.[3] ..... B67B 7/26

[52] U.S. Cl. ..... 222/83.5; 222/86

[58] Field of Search ..... 222/83, 83.5, 85, 86, 222/81, 88, 89, 80, 90; 30/446, 447

[56] References Cited

U.S. PATENT DOCUMENTS

| | | | |
|---|---|---|---|
| Re. 30,610 | 5/1981 | Gaki et al. | 222/86 |
| 1,861,619 | 6/1932 | Bellmer | 222/80 |
| 1,997,888 | 4/1935 | Sexton | 222/83.5 |
| 2,717,102 | 9/1955 | Rives | 222/89 |

*Primary Examiner*—Stanley H. Tollberg
*Attorney, Agent, or Firm*—Zarley, McKee, Thomte, Voorhees & Sease

[57] ABSTRACT

An oil spout apparatus including an elongated tubular spout having a can piercing blade extended from one end and a butterfly valve positioned interiorly of the spout for movement between a closed position wherein the valve is oriented transversely of the spout to substantially retard oil flow through the spout and an open position wherein the valve is oriented generally perpendicularly to its closed position whereby oil flow through the spout is substantially unimpeded. A handle positioned exteriorly of the spout is connected to the valve for moving it between its closed and open positions and providing a visual indication of the position of the valve. In an alternate embodiment, the spout is provided with a pair of spaced apart inlet end portions which feed a single outlet end. Each inlet end portion is provided with a can piercing blade and butterfly valve so that a pair of oil cans may be independently pierced by and supported on the respective inlet ends of the spout apparatus.

3 Claims, 7 Drawing Figures

OIL SPOUT WITH VALVE

BACKGROUND OF THE INVENTION

The present invention is directed generally to oil spouts for facilitating the pouring of oil from oil cans and more particularly to such an oil spout provided with a butterfly valve interiorly thereof for retarding oil flow through the spout until the can and spout are properly positioned for emptying the contents of the can into a receptacle.

Perhaps the most common type of oil spout in current use includes an elongated generally tubular spout having a can piercing blade extended from one end thereof with an adjacent arcuate shroud whereby when the blade pierces an edge of the top of an oil can, the sidewall of the can is received between the blade and shield. The assembled spout and can need only be inverted for emptying the oil from the can through the spout.

In modern automobiles, there is often so much accessory equipment within the engine compartment that there is insufficient room to place the oil can in an upright position to arrange the end of the spout adjacent the oil filler opening of the engine prior to inverting the can. Usually, the can has to be held in an upright position somewhat above the oil filler opening and then inverted with the hope that the spout can be inserted into the oil inlet opening before too much oil misses and drips onto the engine. Accordingly, there is a need for an improved oil spout which retards oil flow through the spout until the inverted can and spout can be properly positioned for emptying the contents of the can into the desired receptacle.

A primary object of the invention therefore is to provide an improved oil spout.

Another object is to provide an improved oil spout having a butterfly valve positioned interiorly thereof for retarding oil flow through the spout when the valve is in its closed position.

Another object is to provide an improved oil spout which enables an assembled oil can and spout to be inverted and properly positioned before the contents of the can are permitted to be emptied through the spout.

Another object is to provide an improved oil spout having the capability of independently supporting and emptying the contents from a pair of oil cans simultaneously.

Another object is to provide an improved oil spout which is simple and rugged in construction, durable in use and efficient in operation.

SUMMARY OF THE INVENTION

The improved oil spout apparatus of the present invention is of the type having a can piercing blade extended from one end of an elongated tubular spout such that upon insertion of the blade into the top of an oil can, oil may be poured from the can through the spout upon inversion of the can. The improvement comprises a butterfly valve supported interiorly of the spout for pivotal movement between a closed position wherein the valve is oriented transversely of the spout to substantially retard oil flow through the spout and an open position wherein the valve is oriented generally perpendicularly to its closed position so that oil can flow through the spout substantially unimpeded. A handle is connected to the valve and positioned exteriorly of the spout for moving the valve between its closed and open positions and for providing a visual indication of the position of the valve. Thus the improved oil spout of the present invention can be inserted into an oil can and the assembled can and spout may be inverted with the butterfly valve in its closed position for properly positioning the free end of the spout in a desired receptacle. Upon opening the butterfly valve, all of the oil is emptied into the receptacle without the spillage associated with prior spouts.

DESCRIPTION OF THE PREFERRED EMBODIMENTS

Figures 1, 2, 3, 4, 5, 6, 7:
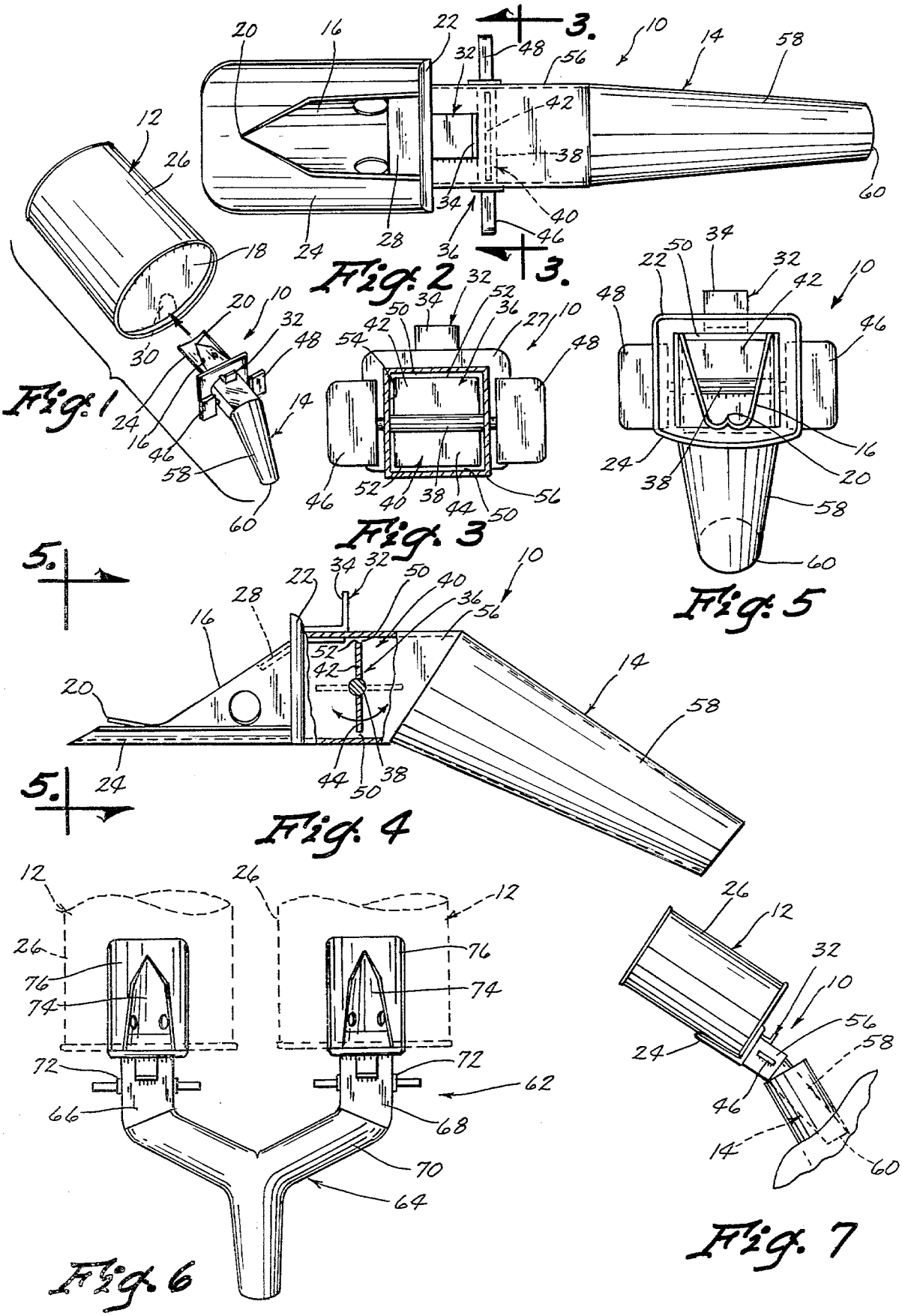
FIG. 1 is a perspective view of the oil spout and an oil can.
FIG. 2 is an enlarged top view of the oil spout.
FIG. 3 is an end sectional view of the butterfly valve as seen on line 3—3 in FIG. 2.
FIG. 4 is a partially sectional side elevational view of the oil spout.
FIG. 5 is an end view of the oil spout as seen on line 5—5 in FIG. 4.
FIG. 6 is a top view of an alternate embodiment of the oil spout adapted to receive two oil cans.
FIG. 7 is a diagrammatic side view indicating oil being poured through the spout with the valve open.

The improved oil spout apparatus 10 of the present invention for pouring oil from an oil can 12 includes an elongated generally tubular spout 14 having a can piercing blade 16 extended from one end of the spout for piercing the top wall 18 of an oil can 12 and insertion into the can in the known manner. The blade 16 is generally U-shaped in transverse cross section and tapers outwardly away from the spout to form a pointed tip 20. A generally U-shaped retainer member 22 connects the blade to one end of spout 14. The retainer member 22 also supports the arcuate shield 24 which also extends outwardly from the same end of the spout as the blade 16 in close generally parallel association with the blade for receiving the can sidewall 26 between the blade 16 and shield 24 when the blade is inserted into the can. The blade 16 may be provided with a cross member 28 adjacent retainer member 22 for depressing the pierced portion 30 of the top of the can to enable free oil flow therefrom. Retainer member 22 may be provided with a generally L-shaped thumb stop 32 having a portion 34 directed generally radially of the spout to provide a bearing surface for pressing blade 16 into the top of oil can 12. The structure of the oil spout apparatus 10 as thus far described is substantially conventional.

The improvement of the present invention is directed to a butterfly valve indicated generally at 36 which is supported interiorly of the spout 14.

Referring to FIG. 3, butterfly valve 36 includes a pivot rod 38 which is extended through openings on opposite sides of the spout 14 so as to be pivotally supported therein. A generally planar valve plate 40 is secured to the rod interiorly of the spout 14 for pivotal movement with the rod 38. The precise structure of the butterfly valve 36 is not critical to the present invention. For example, an integral plate may be welded or otherwise secured to one edge of pivot rod 38 or a pair of valve plate portions 42 and 44 may be secured to opposite sides of the pivot rod 38 in a common plane by welding or any other suitable means. The valve plate portions 42 and 44 may be secured to an annular collar which, in turn, is crimped onto the pivot rod 38 for rotation with it.

A pair of handles 46 and 48 are secured to opposite ends of the pivot rod 38 at positions exteriorly of spout 14 for pivotally moving the valve plate 40 between its closed position indicated in solid lines in FIG. 4 and its open position indicated in dotted lines in the same Figure. Handles 46 and 48 are preferably flat members secured to the pivot rod 38 generally parallel to the valve plate 40 so as to provide an exterior visual indication of the position of the valve plate 40.

Valve plate 40 is of a size and shape relative to the spout 14 such that when the valve is in its closed position of FIG. 3, a slight peripheral clearance 50 is provided between the exterior periphery 52 of the valve plate 40 and the interior periphery 54 of spout 14. Accordingly, the tolerances involved in the formation and assembly of the apparatus 10 are such that it may be manufactured economically without impairing its efficient operation. It is not necessary that the valve plate completely prevent the passage of oil past the plate in its closed position but only that it substantially retard flow of oil sufficient to enable the inverted spout to be properly positioned for emptying oil from the can before drippage would occur. In other embodiments, a flexible valve portion may extend outwardly from the periphery of valve plate 40 to effect a more intimate seal with the spout 14 or the valve plate itself may be formed of somewhat resilient material such as hard rubber.

Referring to FIGS. 3–5, spout 14 includes an enlarged end portion 56 having a generally square cross sectional shape which extends forwardly to merge with a forwardly tapering free end portion 58 which has a generally circular cross sectional shape at its terminal end 60. Butterfly valve 36 is preferably positioned within the enlarged end portion 56 adjacent the blade 16 so as to be accessible when the blade is inserted into a can and the free end 58 of the spout is inserted into a receptacle as indicated in FIG. 7.

An alternate embodiment of the invention is disclosed in FIG. 6 wherein an oil spout apparatus 62 includes a spout 64 having a pair of generally parallel spaced apart inlet end portions 66 and 68 which communicate with a generally Y-shaped outlet end portion 70 so that both inlet end portion 66 feed the single outlet end 70. Otherwise, each inlet end portion 66 is provided with a butterfly valve 72, a can piercing blade 74 and arcuate shield 76 of like construction to the corresponding parts in the embodiment of FIGS. 1–5 and 7.

In operation, the can piercing blade 16 is inserted into the top of an oil can 12 in the usual manner. The butterfly valve 36 is then pivoted to its closed position and the assembled can and spout apparatus 10 can be moved to a position above the intended opening or receptacle into which the oil is to be emptied. The can and spout assembly are inverted and the free end of the spout is inserted into a receptacle. The more accessible handle 46 or 48 is then pivoted to move the valve plate 40 to its open position so that oil can flow from the can through the spout and into the receptacle such as the oil inlet opening of an automobile engine. Since the valve plate 40 in its open position is oriented parallel to the direction of flow through the spout 14, oil can flow through the spout substantially unimpeded by the open valve. Another advantage of the present invention is that if only a portion of the contents of an oil can are intended to be emptied into a receptacle, the butterfly valve 36 may be closed after the desired amount of oil has passed through the spout whereupon the can and spout may be raised from the receptacle and inverted to its upright position without spillage of oil in the process.

Thus there has been shown and described an improved oil spout apparatus which accomplishes at least all of the stated objects.

I claim:

1. In an apparatus for pouring oil from oil cans, said apparatus including an elongated generally tubular spout having a can piercing blade extended from one end thereof such that upon insertion of said blade into the top of an oil can, oil may be poured from the can through said spout upon inversion of the can, the improvement comprising a valve, means for supporting said valve interiorly of said spout for movement between a closed position wherein said valve is oriented transversely of said spout to substantially retard oil flow through said spout and an open position wherein said valve is oriented generally perpendicularly to said closed position whereby oil flow through said spout is substantially unimpeded, and means connected to said valve and positioned exteriorly of said spout for moving said valve between said closed and open positions, said valve comprising a butterfly valve including a pivot rod extended through said spout and pivotally supported thereon, and a valve plate secured to said rod interiorly of said spout for pivotal movement therewith, said means for moving said valve between said closed and open positions comprising a handle secured to one end of said rod in response to pivotal movement of said handle, said handle being an elongated member directed generally parallel to said valve plate whereby the pivotal position of said handle provides an indication of the position of said valve plate, said valve being of a size and shape relative to said spout such that when said valve is in the closed position, a slight peripheral clearance is provided between the exterior periphery of said valve and the interior periphery of said spout, said spout including a generally enlarged neck portion at one end thereof, said can piercing blade being connected to said neck portion and extended generally axially therefrom, and said valve being pivotally supported within said neck portion, an arcuate shield member arranged in close association to said blade and connected to said spout whereby said shield member is operative to direct oil flow into said spout from an oil can pierced by said blade, and said spout being of compact rigid construction such that upon insertion of said can piercing blade into the top of an oil can and insertion of the opposite end of the spout into an oil filler opening, said can is positioned closely adjacent said opening.

2. The apparatus of claim 1 further comprising a second handle secured to the opposite end of said rod for pivotally moving said rod in response to pivotal movement of said second handle.

3. The apparatus of claim 1 wherein said spout includes a pair of generally parallel spaced apart inlet end portions which merge at a medial position along said spout to feed a single outlet end portion, said can piercing blade extending from one inlet end portion and a second can piercing blade extending from the other inlet end portion whereby a pair of oil cans may be independently pierced by and supported on said can piercing blades, said valve being supported interiorly of one inlet end portion and a second valve being supported interiorly of the other inlet end portion.

* * * * *